US009918905B1

(12) United States Patent
Howard et al.

(10) Patent No.: US 9,918,905 B1
(45) Date of Patent: Mar. 20, 2018

(54) MEDICATION CONTAINER WITH SMART CAP

(71) Applicants: Stanley Howard, Powder Springs, GA (US); Sacrial Howard, Powder Springs, GA (US)

(72) Inventors: Stanley Howard, Powder Springs, GA (US); Sacrial Howard, Powder Springs, GA (US)

( * ) Notice: Subject to any disclaimer, the term of this patent is extended or adjusted under 35 U.S.C. 154(b) by 0 days.

(21) Appl. No.: 15/293,229

(22) Filed: Oct. 13, 2016

(51) Int. Cl.

| | |
|---|---|
| ***G08B 13/14*** | (2006.01) |
| ***A61J 7/04*** | (2006.01) |
| ***A61J 1/05*** | (2006.01) |
| ***G08B 21/24*** | (2006.01) |
| *G08B 3/10* | (2006.01) |

(52) U.S. Cl.
CPC . *A61J 7/04* (2013.01); *A61J 1/05* (2013.01); *G08B 21/24* (2013.01); *A61J 2200/30* (2013.01); *A61J 2205/70* (2013.01); *G08B 3/10* (2013.01)

(58) Field of Classification Search
CPC ..... A61J 2205/70; A61J 1/03; A61J 2200/30; A61J 7/0076; A61J 7/0436; A61J 7/0472; G06F 19/3462
USPC ..... 340/568.1
See application file for complete search history.

(56) References Cited

U.S. PATENT DOCUMENTS

| | | | | |
|---|---|---|---|---|
| 4,801,929 | A * | 1/1989 | Instance | B65D 55/028 215/201 |
| 4,845,470 | A * | 7/1989 | Boldt, Jr. | B65D 5/4291 215/201 |
| 4,847,597 | A * | 7/1989 | Dobosi | B65D 51/248 206/459.1 |
| 5,815,586 | A | 9/1998 | Dobbins | |
| 6,239,712 | B1 | 5/2001 | Hawk | |
| 6,259,794 | B1 | 7/2001 | Dobbins | |
| 6,545,594 | B1 * | 4/2003 | Knight | B65D 55/028 206/217 |
| 7,081,807 | B2 | 7/2006 | Lai | |
| 7,295,890 | B2 | 11/2007 | Jean-Pierre | |
| 7,336,194 | B2 | 2/2008 | Hillman et al. | |
| 7,772,981 | B1 * | 8/2010 | Lambert | B65D 47/0842 340/539.1 |
| 7,844,361 | B2 * | 11/2010 | Jean-Pierre | G06F 19/3462 221/2 |
| 8,666,539 | B2 * | 3/2014 | Ervin | A61J 1/03 700/236 |
| 2002/0000908 | A1 * | 1/2002 | Burg, II | B65D 51/248 340/328 |
| 2006/0231972 | A1 | 10/2006 | Kawaguchi et al. | |

(Continued)

*Primary Examiner* — Eric M Blount

(57) ABSTRACT

A smart medication container for providing an automatic, audible playback of recorded and timing information each time it is opened. The smart medication container includes a container base which is an open top container portion and a smart cap connected to the container base through a flexible cord and movable between an open position and closed position. The smart cap includes a sensor for determining when it is removed from the closed position and an audio playback system that plays a prerecorded dosing message and a generated time since last opening message when the smart cap is moved to the open position. The prerecorded dosing message may be stored on a removable storage media so as to allow it to be added, updated or changed by simply providing such a storage media.

7 Claims, 3 Drawing Sheets

(56) References Cited

U.S. PATENT DOCUMENTS

| | | | | |
|---|---|---|---|---|
| 2008/0111685 | A1* | 5/2008 | Olson | B65D 55/028 340/545.6 |
| 2010/0270257 | A1 | 10/2010 | Wachman et al. | |
| 2012/0257478 | A1 | 10/2012 | Marcellino | |
| 2014/0081649 | A1 | 3/2014 | Langdon et al. | |
| 2016/0048657 | A1* | 2/2016 | LeBrun | G06F 19/3462 705/2 |
| 2016/0327427 | A1* | 11/2016 | Briones | A61J 7/02 |

* cited by examiner

MEDICATION CONTAINER WITH SMART CAP

BACKGROUND OF THE INVENTION

Field of the Invention

This invention relates generally to article dispensers and, more particularly, to a cap for a medical container having an electronic interface for information and alerting.

Description of the Prior Art

The use and design of conventional pill containers for storing medication in the form of pills is well known. While such receptacles often include information related to the medication stored therein in written form, a problem which still exists is that many users have trouble reading the small print on such receptacle. Moreover, the mere presence of written indicia on the exterior of the receptacle in no way forces a user to read it prior to accessing the medication inside. As such, conventional pill containers generally do little to prevent a user from accidentally overdosing medication.

Thus, there remains a need for a medication container with smart cap which would force a user to listen to a recorded message each time the cap was removed from the container base. It would be helpful if such a medication container with a smart cap could be loaded with a message recorded by a physician or pharmacist at the time the medication was prescribed or prescription fulfilled. It would be additionally desirable for such a medication container with a smart cap to include a timing feature which also provided the time since last opening each time the cap was removed.

The Applicant's invention described herein provides for a medication container with a smart cap adapted to allow a user to be automatically advised of dosing, timing, and other information for a medication each time the medication is accessed. The primary components in Applicant's medication container with a smart cap are a container base and a smart cap. When in operation, the medication container with a smart cap enables more effective provision information to a patient each time the patient prepares to take the medication. As a result, many of the limitations imposed by prior art structures are removed.

SUMMARY OF THE INVENTION

A smart medication container for providing an automatic, audible playback of recorded and timing information each time it is opened. The smart medication container comprises a container base defining an open top container portion and a smart cap connected to the container base through a flexible cord and movable between an open position and closed position. The smart cap includes a sensor for determining when it is removed from the closed position and an audio playback system that plays a prerecorded dosing message and a generated time since last opening message when the smart cap is moved to the open position. The prerecorded dosing message may be stored on a removable storage media so as to allow it to be added, updated or changed by simply providing such a storage media.

It is an object of this invention to provide a medication container with smart cap which would force a user to listen to a recorded message each time the cap was removed from the container base.

It is another object of this invention to provide a medication container with a smart cap which could be loaded with a message recorded by a physician or pharmacist at the time the medication was prescribed or prescription fulfilled.

It is yet another object of this invention to provide a medication container with a smart cap to which includes a timing feature which also provided the time since last opening each time the cap was removed.

These and other objects will be apparent to one of skill in the art.

DETAILED DESCRIPTION OF THE INVENTION

Figure 2:
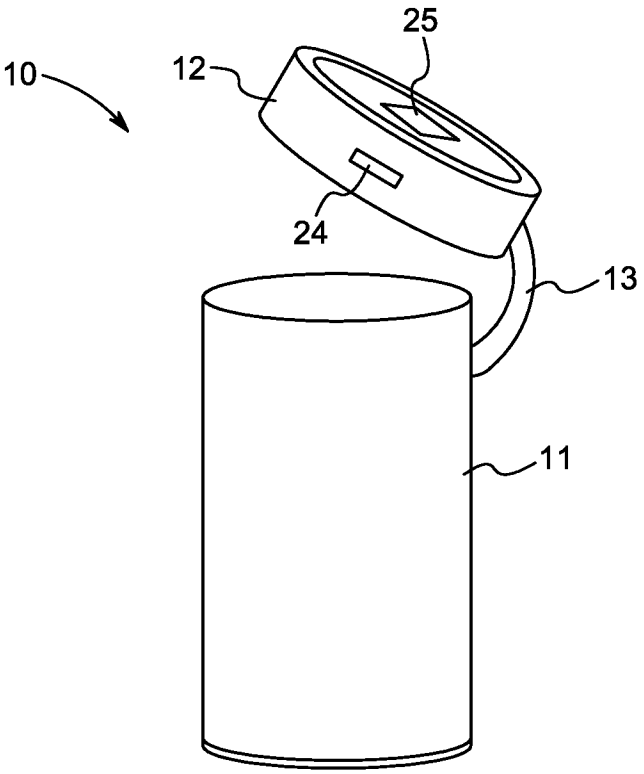
FIG. 2 is a side perspective view of a medication container with a smart cap built in accordance with the present invention with the smart cap in an open position.
Figure 1:
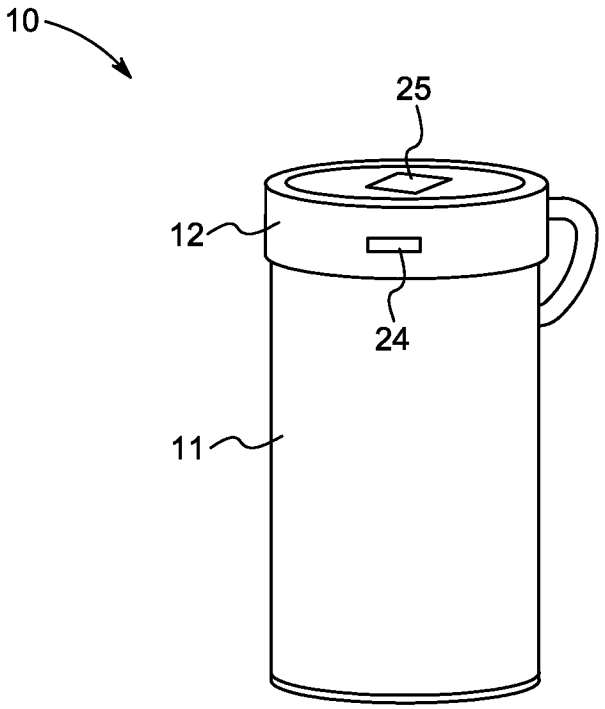
FIG. 1 is a side perspective view of a medication container with a smart cap built in accordance with the present invention with the smart cap in a closed position.
Figure 3B:
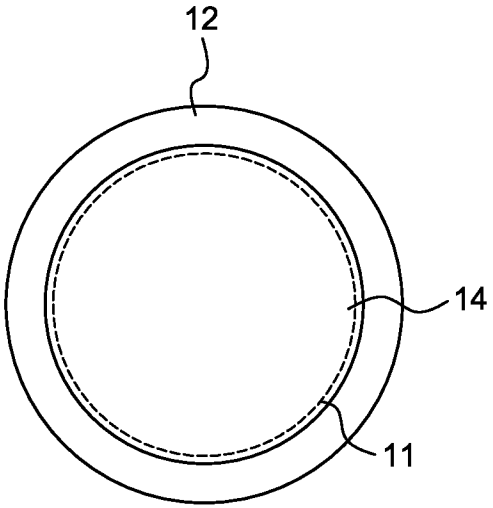
FIG. 3B is a bottom plan view of a smart cap of a medication container with a smart cap built in accordance with the present invention with a position button in an retracted position.
Figure 3A:
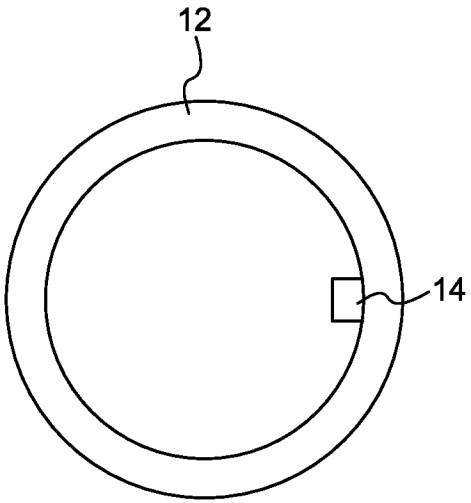
FIG. 3A is a bottom plan view of a smart cap of a medication container with a smart cap built in accordance with the present invention with a position button in an extended position.
Figure 5:
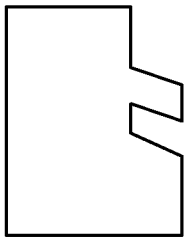
FIG. 5 is a top plan view of a removable media card of a medication container with a smart cap built in accordance with the present invention.
Figure 4:
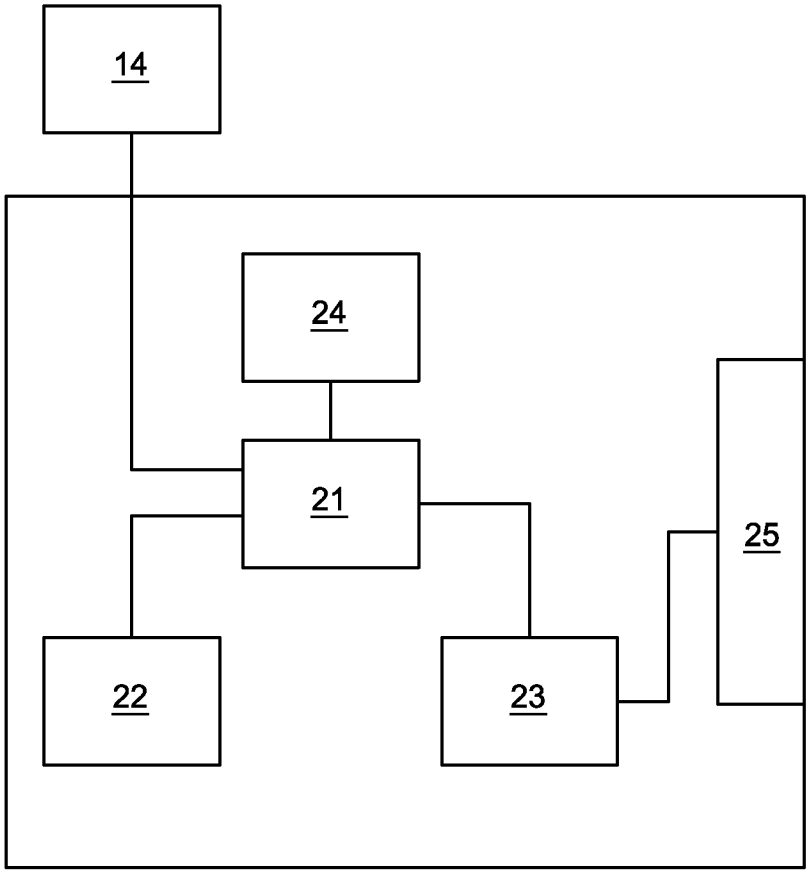
FIG. 4 is a block diagram showing the components of a smart cap of a medication container with a smart cap built in accordance with the present invention.

Referring now to the drawings and in particular FIGS. 1, 2, 3, and 4, a smart medication container 10 is shown having a container base 11 and a smart cap 12. The container base 11 defines an open top container portion of a conventional prescription bottle. In this regard, the container base 11 is adapted to receive and hold medication in at least a pill form. As with conventional prescription bottles, in one embodiment the container base 11 is cylindrical and orange or light brown. It is contemplated, however, that in alternate embodiments the container base 11 may define alternate shapes or colors.

The smart cap 12 is connected to the container base 11 through a flexible cord 13. Through the cord 13, the container base 11 and the smart cap 12 remain attached whether the smart cap 12 is in the closed position, defined by the smart cap 12 positioned on top of the container base 11 so as to cover the open top and form an enclosure, or the open position, defined by the smart cap 12 being removed from a position covering the open top. It is appreciated that the cord 13 must be long enough to allow for the use of conventional child-resistant features on the container base 11 and smart cap 12.

In one embodiment, the smart cap 12 includes position button 14 and an audio playback system 20 that includes a controller 21, power source 22, a sound card 23, media interface 24, and a speaker 25. In one embodiment, the position button 14 defines a spring biased button that includes an internal contact sensor and is wired to the controller 21. In this regard, the position button 12 is biased to move to an extended position when the smart cap 12 is in the open position off the container base 11 and operative to move to a retracted position when the smart cap 12 is in the closed position on the container base 11. In one embodiment, the position button 14 generates and transmits an electrical signal to the controller 21 every time the it moves to the extended position. In some embodiment, the position button 14 generates and transmits an electrical signal to the controller 21 every time the it moves to the extended and/or retracted position.

The components of the smart cap 12 are interconnected so as to allow electrical power from the power source 22 to be distributed to each of the position button 14, controller 21, sound card 23, media interface 24, and speaker 25 and to allow the controller 21 to direct stored data which corresponds to recorded sound from the media interface 24 to the sound card 23 to be converted from digital to analog by the sound and then to the speaker 25 to be played aloud.

On one embodiment, digital data which corresponds to recorded sound is provided to the media interface 24 through the insertion of a removable media card 30. In one embodiment, the removable media card 30 defines a microSD card and the media interface 24 defines a microSD card reader.

In an alternate embodiment, digital data for directing to the sound card 23 may be stored on a memory device either built into the controller or that is integral with the audio playback system 20.

In some embodiments, the audio playback system 20 includes a wireless networking antenna and can receive digital data which corresponds to recorded sound therethrough.

In operation, each time the controller 21 receives a signal from the position button 14 indicating that the smart cap 12 is in the open position, the controller 21 causes the speaker 25 to play a prerecorded message that is stored in digital form on a removable media card 30 that has been inserted into the media interface 24. In addition, the controller 21 causes the speaker 25 to state the amount of hours and minutes since the last time the position button 14 moved to the extended position. In this regard, each time a user removes the smart cap 12 from the container base 11, the smart cap 12 can play an audio message from a doctor and/or pharmacist and the time since the container base 11 was last accessed (based on the last time it was opened).

It is contemplated that the timing function in the audio playback system 20 may be provided through a hardware timer, such as a digital counter.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A smart medication container, comprising:

a container base defining an open top container adapted to receive and hold medication;

a smart cap adapted to move between a closed position defined by the smart cap being positioned on the container base so as to cover the open top and create an enclosure between the smart cap and container base and an open position defined by the smart cap not covering the open top, wherein said smart cap is adapted to sense when the smart cap is moved to the open position; and an audio playback system having a speaker integral with said smart cap, wherein said audio playback system is adapted to cause the speaker to play an audible message when the smart cap senses the smart cap is moved to the open position, and wherein said audible message played by the audio playback system is stored on a removable media member connected to audio playback system.

2. The smart medication container of claim 1, wherein said smart cap is attached to said container base with a flexible cord.

3. The smart medication container of claim 1, wherein said audio playback system is entirely contained in said smart cap.

4. The smart medication container of claim 1, wherein said smart cap is adapted to sense when the smart cap is moved to the open position through a spring biased position button that extends from the surface of the smart cap.

5. The smart medication container of claim 1, wherein said removable media member defines a microSD card.

6. The smart medication container of claim 1, wherein said removable media member is connected to audio playback system through a media interface integrated with said smart cap.

7. A smart medication container, comprising:

a container base defining an open top container adapted to receive and hold medication;

a smart cap attached to said container base with a flexible cord and adapted to move between a closed position defined by the smart cap being positioned on the container base so as to cover the open top and create an enclosure between the smart cap and container base and an open position defined by the smart cap not covering the open top, wherein said smart cap is adapted to sense when the smart cap is moved to the open position through a spring biased position button that extends from the surface of the smart cap;

an audio playback system integral with said smart cap, wherein said audio playback system includes a speaker and is adapted to cause the speaker to play an audible message when the smart cap senses the smart cap is moved to the open position;

wherein said audible message played by the audio playback system is stored on a removable media member connected to audio playback system; and wherein said removable media member is connected to audio playback system through a media interface integrated with said smart cap.

* * * * *